US006357895B1

(12) United States Patent
Kierulf et al.

(10) Patent No.: US 6,357,895 B1
(45) Date of Patent: Mar. 19, 2002

(54) ARM-MOUNTED LUMINAIRE WITH CLAMPING ELEMENTS

(75) Inventors: Bjoern Kierulf; Anton Bendis, both of Bratislava (DE)

(73) Assignee: Azuma Limited, MT-Vellette (MA)

( * ) Notice: Subject to any disclaimer, the term of this patent is extended or adjusted under 35 U.S.C. 154(b) by 0 days.

(21) Appl. No.: 09/505,537

(22) Filed: Feb. 17, 2000

(30) Foreign Application Priority Data

Feb. 18, 1999 (DE) ..... 199 06 743

(51) Int. Cl.[7] ..... F21V 21/00

(52) U.S. Cl. ..... 362/396; 362/414; 362/439; 362/430; 362/431; 292/306; 292/305; 292/257; 248/514; 248/74.2; 248/124.2

(58) Field of Search ..... 362/382, 396, 362/413, 414, 416, 429, 430, 431, 449; 292/305, 256, 257, 256.6; 248/511, 514, 74.1, 74.2, 74.5, 74.4, 124.2, 121, 122.1, 124.1, 125.8, 125.9, 126

(56) References Cited

U.S. PATENT DOCUMENTS 963,913 A * 7/1910 Lyhne ..... 248/124.2
1,408,834 A * 3/1922 Seavey ..... 403/59
1,449,658 A * 3/1923 Deach ..... 248/124.2
1,777,185 A * 9/1930 Thompson ..... 248/124.2
5,398,177 A * 3/1995 Harwood ..... 362/270

* cited by examiner

*Primary Examiner*—Sandra O'Shea
*Assistant Examiner*—Ismael Negron
(74) *Attorney, Agent, or Firm*—Roseman & Colin LLP

(57) ABSTRACT

A luminaire, and in particular an arm-mounted spotlight or a picture light, having a long slim stem with a lighting head at one end and fixing elements at the other end. The fixing elements have clamping ends which engage at least partially around the stem and which can be operated by hand between a clamping position and a loosening position. In one embodiment, the clamping elements are each formed as clamping sleeves which embrace the stem annularly and have open ends which have flanges which can be moved toward each other by a finger grip in order to achieve the clamping action. In another embodiment, clamping elements are biased into a closed position by a spring and finger grips are provided to open the clamping elements when pressed.

4 Claims, 3 Drawing Sheets

ARM-MOUNTED LUMINAIRE WITH CLAMPING ELEMENTS

BACKGROUND OF THE INVENTION

1. Field of the Invention

The invention relates to a luminaire, in particular an arm-mounted spotlight or a picture light, having a long slim stem as a boom, at whose one end a lighting head is provided and at whose other end fixing elements are provided.

2. Description of the Prior Art

Luminaires of this type are either mounted permanently on the wall, which is the case in conventional picture lights, or are used as arm-mounted spotlights on exhibition stands, fixing elements which, in particular, permit fixing to the upper edge of supporting elements being expedient. A picture light of the type mentioned at the beginning is disclosed, for example, by the German Registered Design specification 29707541.

General requirements on such luminaires relate both to their form and to their function. A particularly long slim stem is desired, which lends to the luminaires a visible lightness; the lighting head should be fixed to this stem in such a way that its position can be changed around the stem in a simple way. As far as the fixing elements are concerned, in particular in the case of an arm-mounted spotlight, the point is that these permit simple adaptation to different wall thicknesses of a supporting element, in particular a dividing wall, a partition wall, a room divider or the like.

SUMMARY OF THE INVENTION

Accordingly, the object of the present invention is to design the fixing elements both for the lighting head and also for fixing the luminaire as a whole in such a way that they are simple to handle and can be used universally.

According to the invention, this object is achieved, in a luminaire of the type mentioned at the beginning, as claimed in the defining part of claim 1 or claim 2.

In this way, it is very simply possible not only to fix the luminaire as such, in that clamping elements are brought into contact with a supporting element from both sides; clamping elements present on the lighting head itself also permit the simple adjustment of the lighting head along the stem, specifically both in the longitudinal direction and by rotating it about the stem, care having simply to be taken that the lighting head is connected flexibly to a power source via an electric cable. A particularly expedient cable connection provides for the stem to be formed as a hollow tube through which the cable is routed, so that said cable is connected to the lighting head at one end of the stem and, at the other end, ends with a power plug.

In the embodiment with a clamping sleeve, the clamping is produced by simply pivoting the finger grip, the finger grip permitting a pivoting lever with a clamping profile to be operated and said profile embracing the two flanges from the outside in such a way that said flanges are increasingly moved toward each other as they are pivoted further, until the clamping position is reached. Because the flanges are moved together, the clamping sleeve is clamped around the stem until the clamping position of the clamping element has been implemented. In this position, the clamping element can be used, for example, as a stop against one side of a supporting element. A further clamping element forms the stop from the other side of the supporting element. The two clamping elements together therefore hold the luminaire on the upper edge of the supporting element. In this case, it is advantageous if the stem has a circular cross section, but is deformed ovally in the area of the clamping sleeves. This permits an additional antirotation safeguard of the stem within the clamping sleeves to be achieved. Nor does the luminaire rotate either when the lighting head is firmly clamped at the other end of the stem, pivoted toward the side.

In particular for fixing the lighting head, the design variant as claimed in claim 2 can be advantageous, in which at least two clamping elements are biased into the closed position against the stem by means of spring force, finger grips being provided on the clamping elements in such a way that when the finger grips are pressed together the clamping elements open.

A special clamping or opening mechanism is rendered superfluous in the abovementioned variant by the fact that in each case a clamping element is connected to a half shell of a sheet metal shield of the lighting head, and that the half shells can be operated, by means of the finger grips and counter to the spring force, to loosen the clamp connection.

In this variant, another preferred refinement provides for the half shells to be loaded in a spread position, by spring means arranged between them, in such a way that when the finger grips are operated the half shells are moved together but the clamping elements are moved apart.

BRIEF DESCRIPTION OF THE DRAWINGS

In the following text, exemplary embodiments of the invention will be explained with reference to the drawing, in which.

DESCRIPTION OF THE PREFERRED EMBODIMENTS

Figure 1:
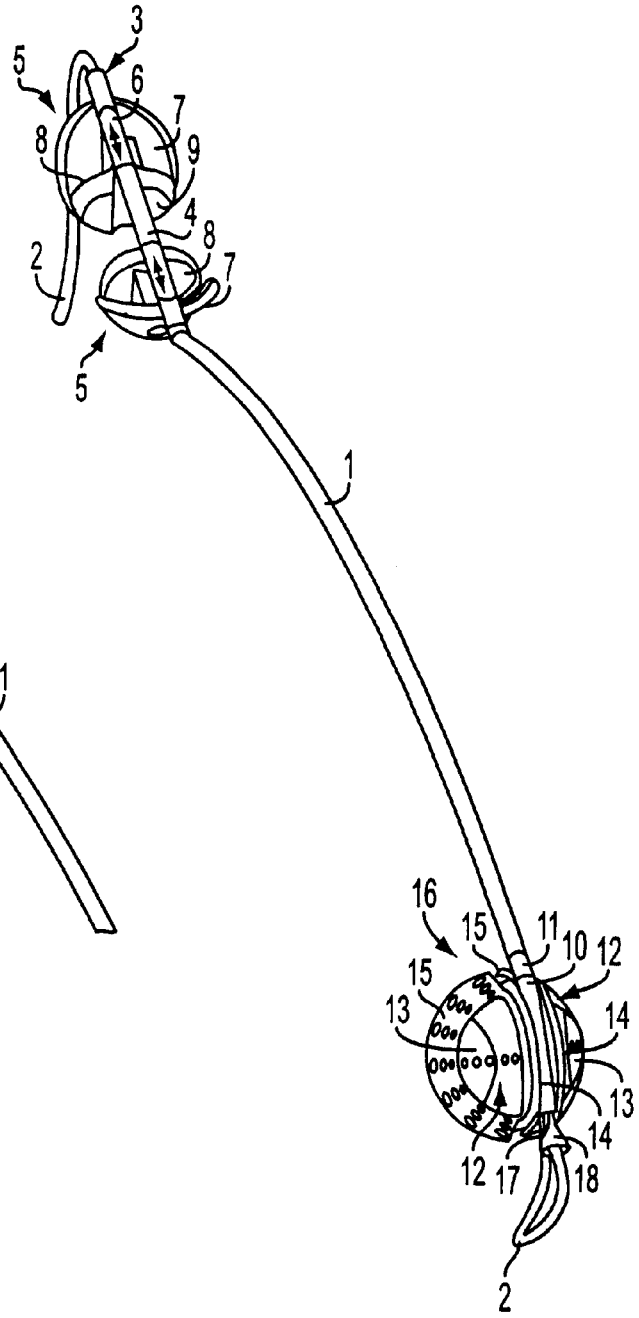
FIG. 1 shows an arm-mounted spotlight in a perspective illustration.

According to FIG. 1, an arm-mounted spotlight is composed of a long slim tubular stem 1, through which an electric cable 2 is routed. At the rear end 3 of the stem 1, the cable 2 is illustrated as being cut off; it ends with a power plug (not shown).

Close to the rear end 3 of the stem 1, the latter has a tubular section 4, on which two clamping elements 5, each of which comprises a clamping sleeve 6 and a finger grip 7, are fitted. The clamping sleeve 6 is in each case composed of polyamide. It has clamping jaws 8 which project on both sides, transversely with respect to the stem, on whose stop side rubber pads 9 are fixed. The rubber pads are about 5 mm thick and have a hardness of about 80 Shore. When the clamp connection is loosened, both clamping elements 5 can be displaced along the tubular section 4 of the stem 1, in the direction of the double arrows shown. In the area of the tubular section 4, the tubular profile of the stem 1, which otherwise has a circular cross section, is deformed elliptically, for example in such a way that with a tube diameter of about 8 mm, the axes of the ellipse are about 9 and 7 mm.

Figure 7:
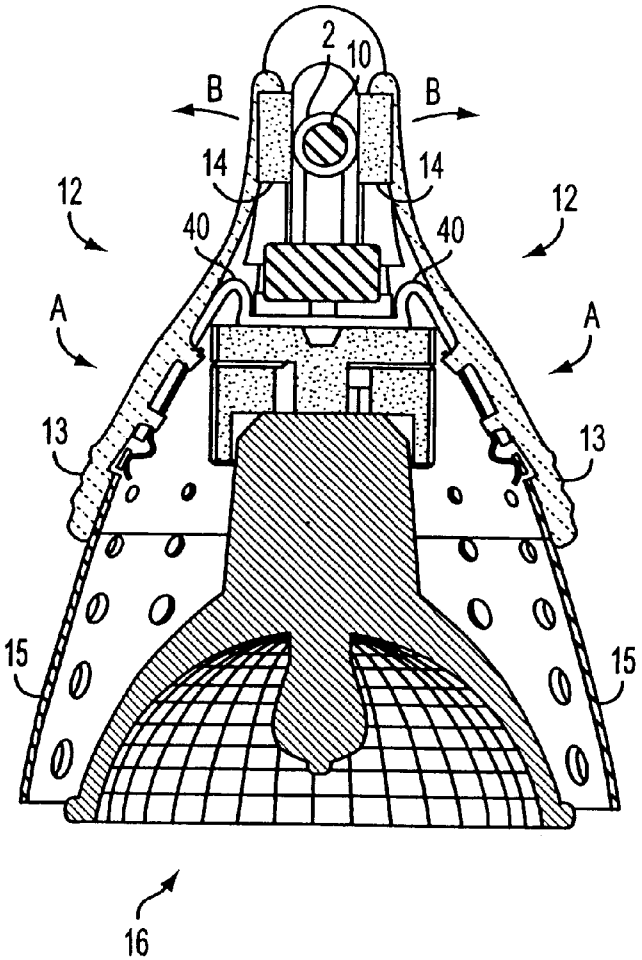
FIG. 7 is a cross-section taken along 7—7 of FIG. 6.
Figure 6:
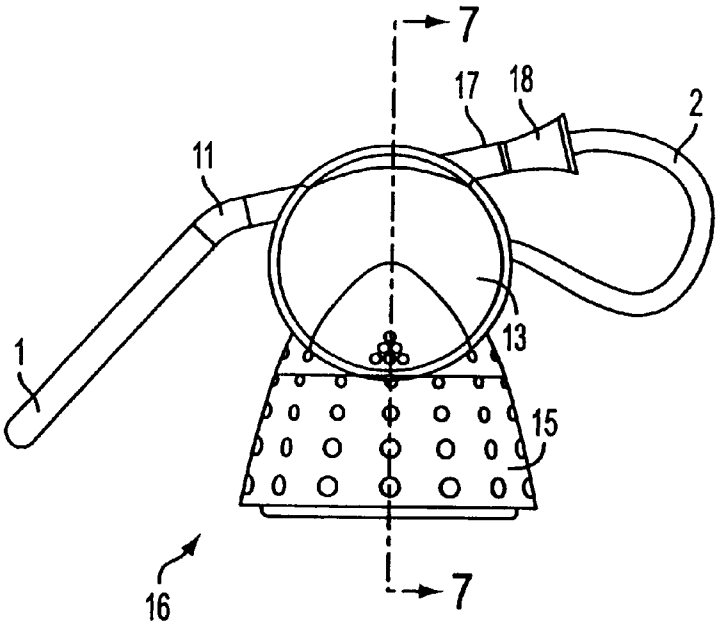
FIG. 6 is a side elevation of the front end of the luminaire.

As shown in FIGS. 1, 6 and 7, at the front end 17 of the stem 1 as well, an end section 10 of the stem 1 is formed rectilinearly, specifically following a bend 11. At section 10, clamping elements 12 act on opposite sides. These clamping elements 12 each have a finger grip 13, to whose clamping side a rubber pad 14 is fixed. This pad 14 is of the type already described in relation to the clamping elements 5 at the other end of the luminaire. The finger grips 13 are fixed to perforated half shells 15 which, together, form a sheet metal shield for the lighting head 16.

In order to operate the clamping element 12, the half shells 15, which are biased outward by a spring 40, are pressed together at the finger grips 13 in accordance with force arrows A illustrated in FIG. 7, so that the clamping action against section 10 is released by the the movement of the rubber pads 14 away therefrom in accordance with arrows B illustrated in FIG. 7. The lighting head 16 can then be rotated as required about the associated end section 10 of the stem 1 and clamped in a different position. The cable 2 connected to the lighting head 16 is secured at the front end 17 of the stem 1 by means of a trumpet-shaped strain-relief means 18.

Figure 2:
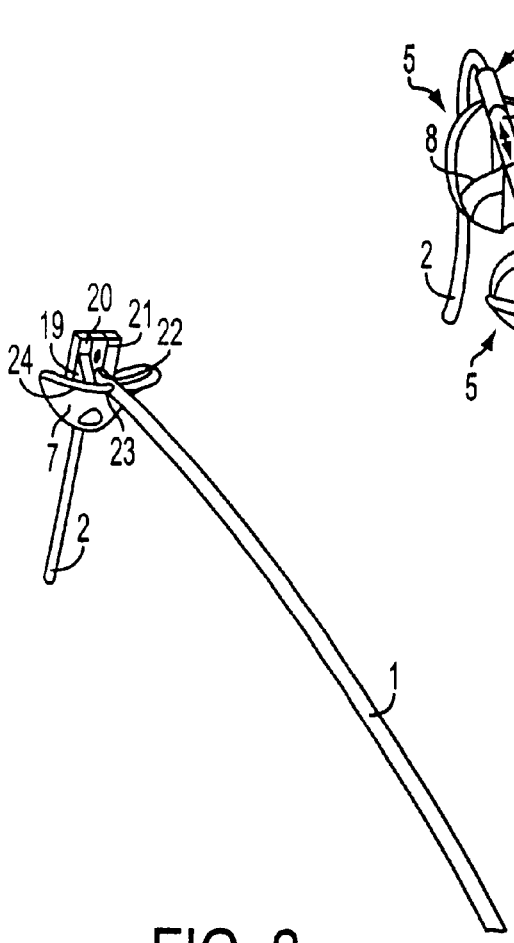
FIG. 2 shows the fixing of a picture light to a wall.

FIG. 2 shows only a rear end section of a luminaire having a wall fixing 19 at the rear end of the stem 1. The wall fixing used is a finger grip 7 in the embodiment of the rear clamping elements 5 according to FIG. 1. Instead of the clamping jaws 8 there, a wall hook plate 20, which has several rows of latching holes 21, is fixed to the finger grip according to FIG. 2. Hooks, which are not illustrated in the drawing but belong to a fixing element 22 at the rear end of the stem 1, enter these latching holes 21. The position of the stem 1 is therefore defined by the latching height of the hooks, on the one hand, and the support of the end of the stem 1 in the interior of a cut 23, facing the stem 1, in the upper edge 24 of the finger grip 7.

Figure 3:
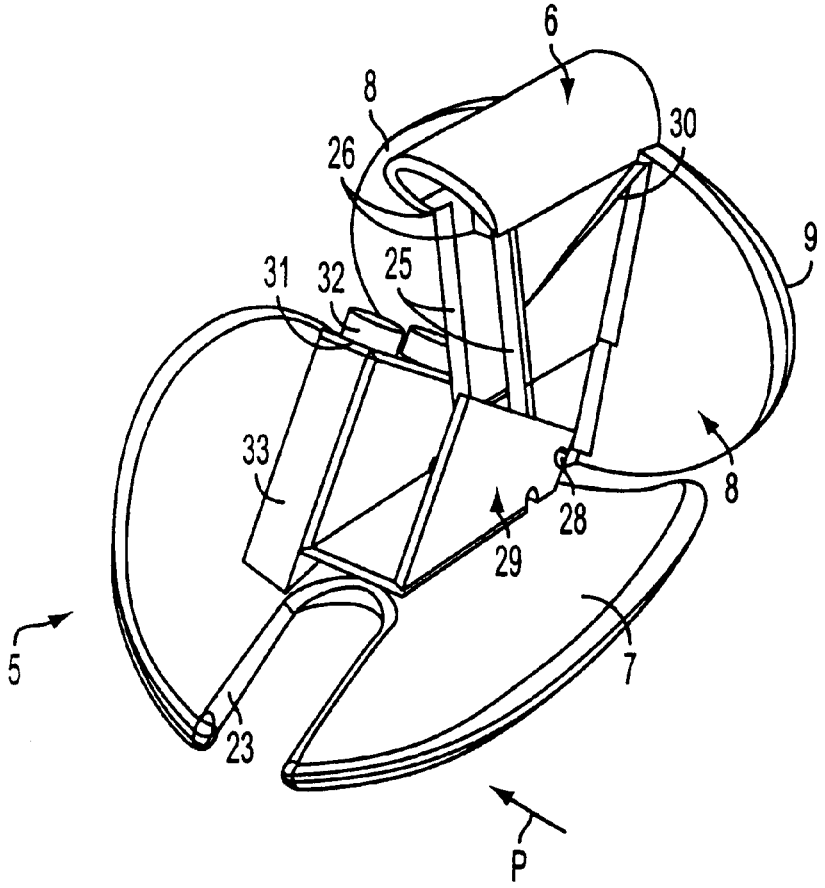
FIG. 3 shows a clamping sleeve with pivoting lever clamping.
Figure 4:
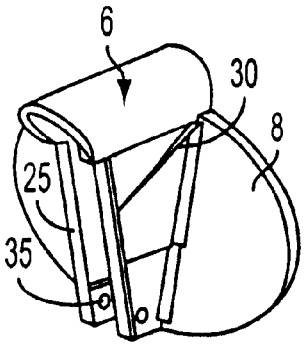
FIG. 4 shows the clamping sleeve according to FIG. 3.
Figure 5:
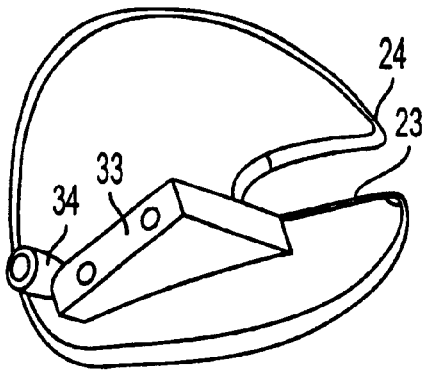
FIG. 5 shows a finger grip belonging to a pivoting lever.

FIGS. 3 and 4 show a clamping sleeve 6 having lateral flanges 25 at its open ends 26. Integrally molded on the flanges 25 are clamping jaws 8, which project laterally on their clamping side and on whose clamping side the rubber pads 9 are fixed. The ovally deformed tubular section 4 of the stem 1 runs in the interior of the clamping sleeve 6. By tilting the finger grip 7 up about its pivot axis 28, the flanges 25 of the clamping sleeve 6 are moved together, by which means the clamping action of the clamping sleeve 6 is implemented. The origin of the clamping action is a clamping profile 29 which is fastened to the rear of the finger grip 7 and has a U-shaped cross section, whose clamping width is selected such that when the finger shell 5 is tilted up the flanges 25 are pressed together. In order to assist this action still further, the flanges 25 have, on their outer sides, wedge-like wall thickenings 30, whose wedge shape increases in thickness toward the clamping jaws 8. At the upper end of the leg of the U-section shown on the left, the clamping profile 29 has a fixing strip 31 which is bent over laterally and which is fixed by means of screws 32 to the front of a rib 33. The rib 33 is cast on to the rear of the finger grip 7, as can clearly be seen in FIG. 5. At its upper edge 24, the clamping element 5 has a cut 23 into which the stem 1 passes when the finger grip 7 is pivoted completely upward as shown by the arrow P (see FIG. 3). In the opened pivoting position of the finger grip, according to FIG. 3, a cylindrical attachment 34, which cannot be seen in FIG. 3 but can be seen in FIG. 5, enters from below between the flanges 25 of the clamping sleeve 6. In this opened position of the flanges 25, the clamping element 5 can be shifted slightly in the longitudinal direction of the associated tubular section 4 of the stem 1.

FIG. 4 shows only the clamping sleeve, as an injection molding made of polyamide. Close to the lower edge of the flanges 25, it is possible to see the holes 35 for accommodating the pivot axis 28 by means of which the finger grip 7 is fixed pivotably to the clamping sleeve 6.

What is claimed is:

1. An arm-mounted luminaire comprising, a long slim stem having a lighting head at one end and fixing elements at the other end, wherein the fixing elements and the lighting head have clamping elements which at least partly engage around the stem, which clamping elements are operable between a clamping position and a loosened position and which, in the loosened position, are pivoted and movable with respect to the stem, and wherein the clamping elements for the fixing elements have clamping sleeves which embrace the stem annularly, said sleeves having open ends with flanges that are movable toward each other by a finger grip in order to achieve the clamping action, and wherein the finger grip operates a pivoting lever which has a clamping profile which embraces the flanges from the outside in such a way that the flanges are increasingly moved toward each other as they are pivoted further, until the clamping position is reached.

2. The arm-mounted luminaire as claimed in claim 1, wherein the stem has a circular cross section but is deformed ovally in the area of the clamping sleeve.

3. An arm-mounted luminaire comprising, a long slim stem having a lighting head at one end and fixing elements at the other end, wherein the lighting head has clamping elements which at least partly engage around the stem, which clamping elements are operable between a clamping position and a loosened position and which, in the loosened position, are pivoted and movable with respect to the stem, wherein at least two clamping elements are biased into the closed position by means of spring force, and wherein finger grips are provided on the clamping elements in such a way that when the finger grips are pressed together the clamping elements open, and wherein each clamping element is connected to a half shell of a sheet metal shield of the lighting head, and wherein the half shells are operated by finger grips and counter to the spring force, to loosen the clamp connection.

4. The arm-mounted luminaire as claimed in claim 3, wherein the half shells are loaded in a spread position, by spring means arranged between them, in such a way that when the finger grips are operated the half shells are moved together but the clamping elements are moved apart.

* * * * *